US005140784A

United States Patent [19]

Walsh

[11] Patent Number: 5,140,784

[45] Date of Patent: Aug. 25, 1992

[54] TOOL GUIDE AND CONTOUR SANDER FOR USE THEREWITH

[76] Inventor: David C. Walsh, 102 Tall Tree Rd., Bogart, Ga. 30622

[21] Appl. No.: 733,297

[22] Filed: Jul. 22, 1991

Related U.S. Application Data

[62] Division of Ser. No. 438,165, Nov. 20, 1989, Pat. No. 5,050,308.

[51] Int. Cl.[5] ..... B24D 17/00

[52] U.S. Cl. ..... 51/358; 51/363; 51/391

[58] Field of Search ..... 51/358, 363, 391, 392

[56] References Cited

U.S. PATENT DOCUMENTS

| | | | |
|---|---|---|---|
| 470,794 | 3/1892 | Shempp | 51/363 |
| 1,062,214 | 5/1913 | Bergman | 51/392 |
| 1,165,452 | 11/1915 | Rudolph . | |
| 1,570,177 | 2/1926 | Pointer . | |

*Primary Examiner*—M. Rachuba

*Attorney, Agent, or Firm*—Jones, Askew & Lunsford

[57] ABSTRACT

A tool guide temporarily attachable to vehicle body panels or other surfaces to provide a straight edge, and contour sander for use in connection with a straight edge. The tool guide includes an elongated member having a longitudinal edge surface for guiding a work tool, and suction cups mounted on tongues extending laterally from the body of the tool guide. The tongues are angled in relation to the body, so that the tongues exert a cantilever force urging the tool guide against a surface when the tongues are secured against the suction cups. The contour sander includes a number of flat blades mounted side-by-side and each having a longitudinal edge for contacting a contoured work surface. A clamp holds the blades in parallel juxtaposition and selectively loosens the blades for conforming contact with the contour. Finger grips are formed at the ends of the blades, allowing the operator to raise or lower any particular blade and obtain a sharper or more accurate reproduction of contour if desired.

8 Claims, 6 Drawing Sheets 84
85
93
20b
21
15
31
32
20a
14
16
19
34
87

88
86
93
91
89
94
94a
95
92
90
15
85

25
15
20
34
19

16
26
25
34
20
29
21
30
35
33
31
32
19

63
68
67
64
62
66
65
40
43
45
55b
44
47
41
46
55a
42
58
57
59
54
56

TOOL GUIDE AND CONTOUR SANDER FOR USE THEREWITH

This is a division of application Ser. No. 438,165, filed Nov. 20, 1989 now U.S. Pat. No. 5,050,308.

FIELD OF INVENTION

This invention relates in general to tools for repairing body damage on motor vehicles and the like, and relates in particular to a contour sander and to a guide tool usable with the sander and for other purposes.

BACKGROUND OF THE INVENTION

Damaged body panels in automobiles and other motor vehicles typically are repaired by bending or hammering the metal to a shape which approximates the original contour of the body panel. A layer of body putty then is applied to the repaired surface of the panel, causing the putty to fill wrinkles and other minor imperfections in the exterior surface of the panel. After the body putty sets to a desired degree of hardness, the surface of the panel is restored to the original surface contour by removing body putty in excess of the surface contour. This putty removal, or at least the final finishing steps of removal, takes place by sanding the surface of the panel to remove high spots of putty and to provide a smooth overall surface finish. This sanded finish must blend with the metal on adjacent undamaged portions of the panel, and also must duplicate the original shape or contour of the panel, in order to provide a professional repaired surface that, after being painted, is visually indistinguishable from the original undamaged surface.

Body panels having only flat surfaces or rounded contours of relatively large radius, but lacking relatively sharp contours or curvilinear features, can be finished using power disk sanders or the like, as the repaired and original portions of the flat or large-radius curved surfaces are more readily blended together. However, relatively linear or elongated surface contours (as found, for example, on door panels) generally must be sanded by hand to blend the sanded finish with the original contour of the panel. This manual sanding usually requires a back-and-forth sanding movement paralleling the linear contour, and for the best result the manual sander or other repair tool should move in parallel alignment with the longitudinal extent of the body contour. Body shop workers in the past either have done without a straightedge, or have improvised one using a yardstick or a similar wooden strip at hand, placing the straightedge against the body panel and visually comparing the straightness of the sanded area with the reference provided by the straightedge. This expedient is time-consuming and inexact, many body repairs take place without using a straightedge, relying on visual observation alone to maintain linear movement of the sander.

In addition to the problem of guiding a sander during a manual sanding operation, known manual sanding devices for sanding longitudinal contoured surfaces also are less than satisfactory. Contour sanders are known which seek to provide accurate contour sanding by matching the existing contour of an undamaged surface. One example of a prior-art contour sander is shown in U.S. Pat. No. 1,570,177. Such contour sanders have a number of individual blades arrayed in parallel within a holder. By pressing the blades against the desired contour while the holder is loosened, the edges of the blades will assume a complementary contour for attaching a piece of sandpaper or other abrasive material. However, such contour sanders of the prior art do not easily duplicate or reproduce a given contour having abrupt angles or other well-defined features.

SUMMARY OF THE INVENTION

Stated in general terms, the body working tool guide of the present invention includes an elongated member having a longitudinal edge surface for guiding a work tool. The longitudinal guide edge of the elongated member is maintained in spaced-apart relation off the work surface, and suction cups temporarily attach the tool to a body panel or other work surface. The contour sander of the present invention cooperates with a straightedge such as the tool guide and includes a number of flat blades each having a longitudinal edge for contacting the work surface. Each blade has a finger grip spaced apart from the work-contacting edge of the blade, so that the position of each individual blade can be adjusted relative to the other blades. A clamp holds the blades in parallel side-by-side juxtaposition, and selectively loosens the blades for conforming contact with the contour of a work surface or tightly clamps together the blade so as to maintain the relative position of the blades in the collective contour.

Stated somewhat more specifically, the suction cups which hold the tool guide to the work surface are mounted on support members extending from the body of the tool guide so as not to interfere with the longitudinal edge surface. In a preferred embodiment, these support members comprise tongues laterally extending from the elongated body of the tool guide and aligned so as to exert a cantilever force urging the elongated body against the work surface whenever the suction cups grip that surface. Turning to the contour sander, the finger grips are formed on at least one end of each blade in position for manual accessibility. These finger grips may be formed at the ends of the blades, and the clamp engages the blades inwardly of the blade ends so as not interfere with manual accessibility of the handles. Each blade preferably has side surfaces which are conducive to grip and hold the confronting surfaces of adjacent blades when clamped tightly together, so as to resist disrupting the collective contour provided by the relative positions of the blades.

DESCRIPTION OF PREFERRED EMBODIMENT

Figure 1:
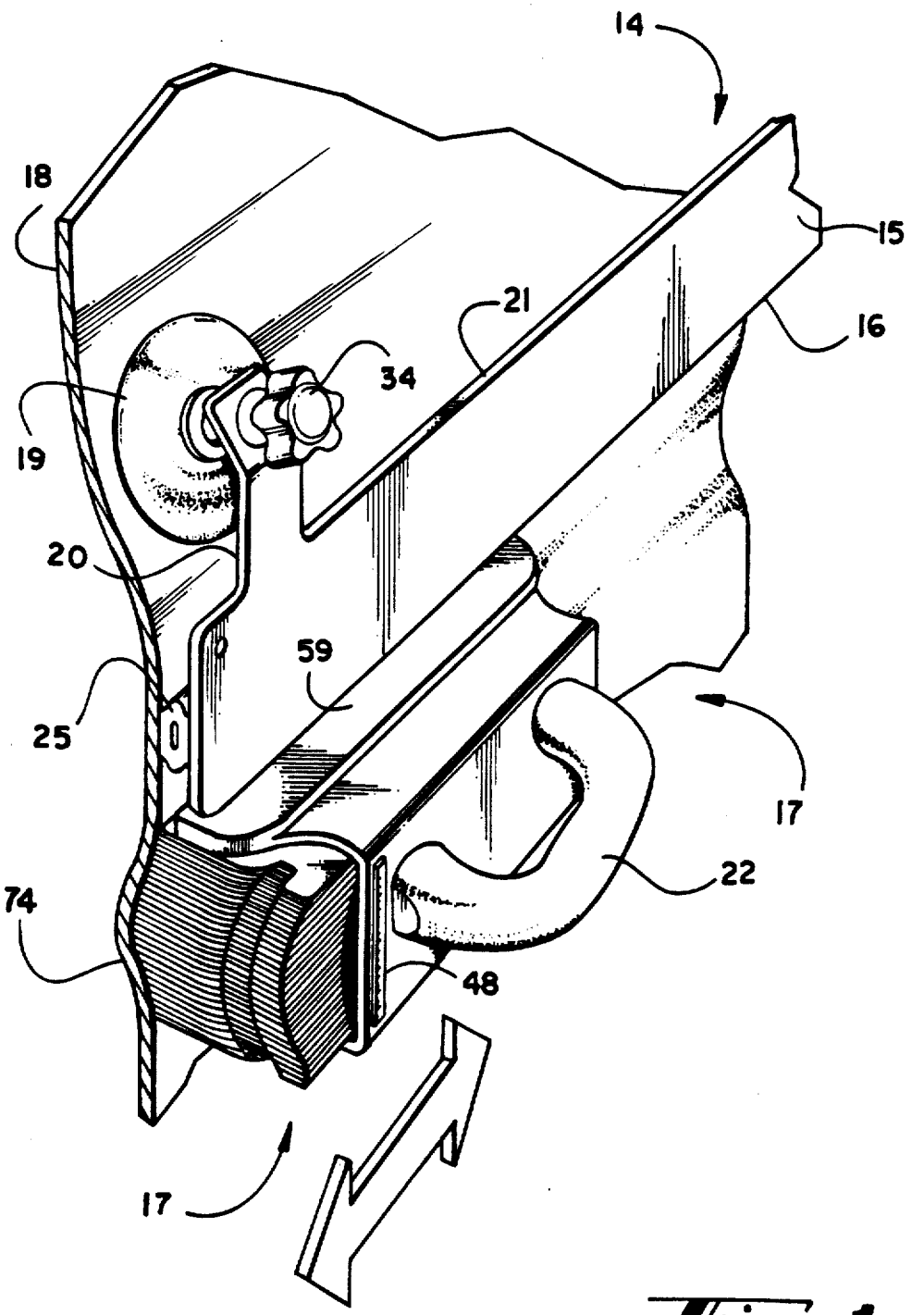
FIG. 1 is a pictorial view fragmentarily showing a tool guide and also showing a contour sander according to a preferred embodiment of the present invention.
Figures 2, 2A, 3, 4:
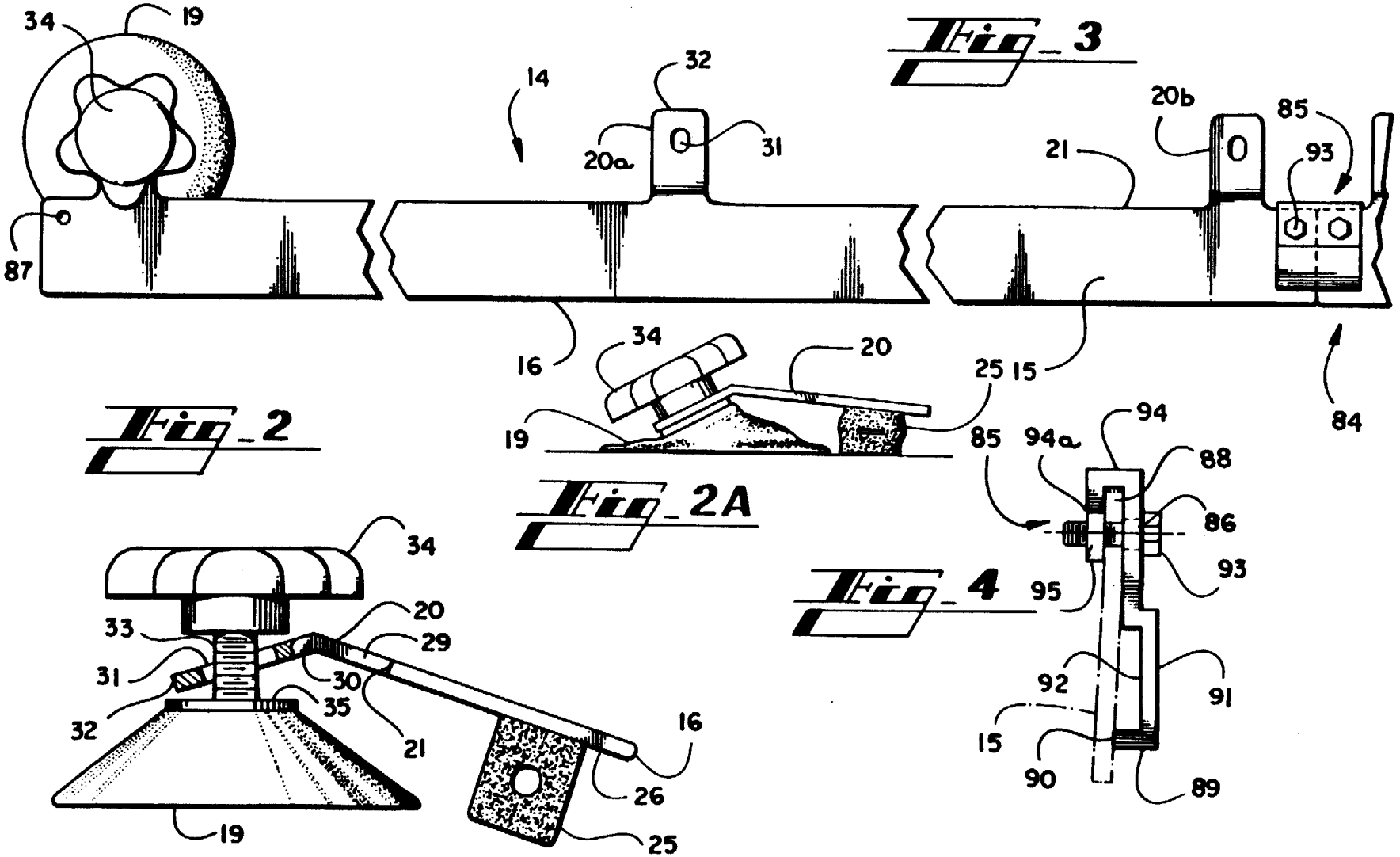
FIG. 2 is a partially-sectioned end view of the tool guide shown in FIG. 1, with the suction cup removed from the work surface.
FIG. 2A is an end view of the tool guide shown in FIG. 1, with the suction cup engaging the work surface.
FIG. 3 is a broken-away plan view showing the tool guide of FIG. 1 attached to another such tool guide.
FIG. 4 is an end view of a guide track connector as used in FIG. 3.

Turning first to FIGS. 1-3, there is shown generally at 14 a tool guide having an elongated body 15 and one side 16 of which defines a straight edge forming a track for guiding the back-and-forth movement of a hand-held contour sander shown generally at 17. The tool guide 15 is shown in FIGS. 1 and 2A temporarily engaging a contoured auto body panel 18 by means of suction cups 19 attached to tongues 20 extending laterally from the side 21 of the tool guide 15 opposite the straight edge 16. Only one such tongue 20 and its associated suction cup 19 are shown in FIG. 1, and the tongues 20*a* and 20*b* are shown in FIG. 3 with the respective suction cups omitted for illustrative purposes. A typical tool guide 15 may be of any desired length, although the preferred length is 27 inches to fit within a standard 27¼ inch long tool box. As best seen in FIGS. 1 and 2A, a bumper strip 25 made of a nonabrasive and preferably elastomeric deformable material such as rubber or the like is secured to the underside 26 of the tool guide 15 spaced inwardly a short distance from the straight edge 16 thereof. This bumper strip 25 contacts the surface of the panel 18 as shown in FIG. 2A, thereby maintaining the straight edge 16 spaced a short distance above the surface of the panel 18 and preventing the tool guide 15 from contacting the panel surface. The edge 16 is preferably rounded as best seen in FIG. 2 to provide a smooth surface presenting relatively low sliding friction to a manual sander or other device sliding along that edge. The tool guide 15 itself preferably is made of a durable yet lightweight material such as aluminum or the like, exhibiting sufficient durability and providing some flexibility for conforming the guide to curved surfaces.

Each tongue 20, as particularly seen in FIGS. 1 and 2, includes a first portion 29 extending outwardly from the side 21 as an extension of the flat tool guide, and a second portion 30 at the outer end of the first portion and extending downwardly at an acute angle to the first portion. A slotted opening 31 is formed through the second portion 30 near the outermost end 32 thereof, and the threaded stud 33 extending upwardly from the back end of the suction cup 19 passes through the slotted opening. A knob 34 has a threaded socket attached to the stud 33, for selectively clamping the outer portion 30 of the tongue 20 between the knob 34 and the back end 35 of the suction cup 19. The longitudinal extent of the slotted opening 31 in each tongue 20 extends parallel to the length of the tongue outer portion 30, and is sufficiently longer than the diameter of the stud 33 to permit the tongue a degree of longitudinal movement relative to the stud. The purpose of this slotted opening and the longitudinal movement permitted thereby is explained below.

Figure 9:
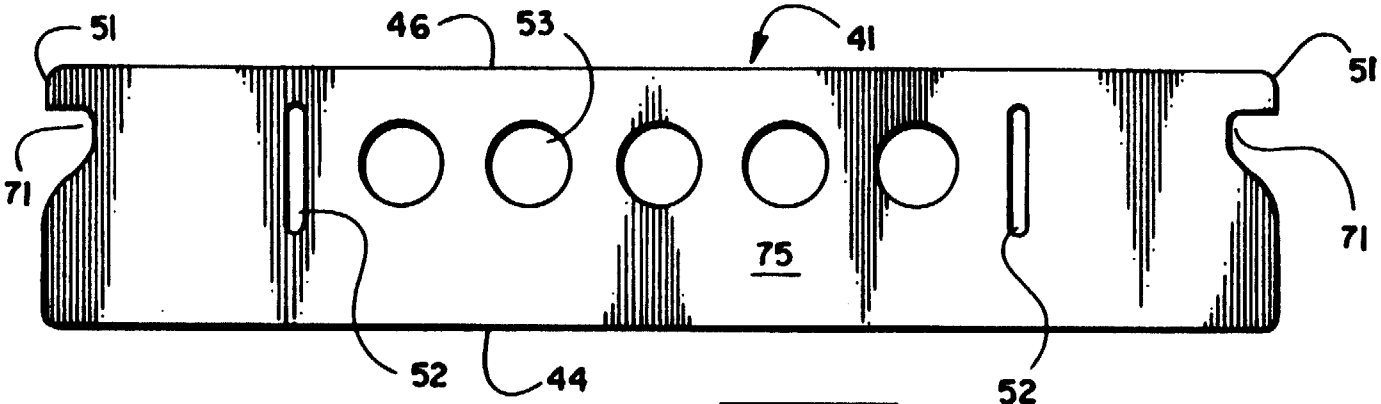
FIG. 9 is a plan view of an individual blade used in the disclosed contour sander.

Details of the contour sander 17 are best seen in FIGS. 1 and 5-7. The contour sander 17 includes a generally U-shaped housing 40 having a number of individual blades 41 received between the parallel spaced-apart sides 42 and 43 of the housing. Each of the blades 41, as best seen in FIG. 9, is a thin, flat elongated sheet stamped or otherwise formed from a suitable material. The blades 41 of the present contour sander preferably are a resilient material such as rubber or the like. Each blade 41 has an elongated lower edge 44 which extends through the open end 45 of the U-shaped housing 40, and an upper edge 46 received within the enclosed upper region 47 of the housing. The ends of the housing 40 are cut away as shown at 50 in FIGS. 6 and 7 to expose the two upper ends 51 of the individual blades 41. A blade reference scale 48 is on the top of the housing 40, as seen in FIG. 1. The scale 48 contains index marks correlated to the blades 41, for a purpose described below.

Figure 5:
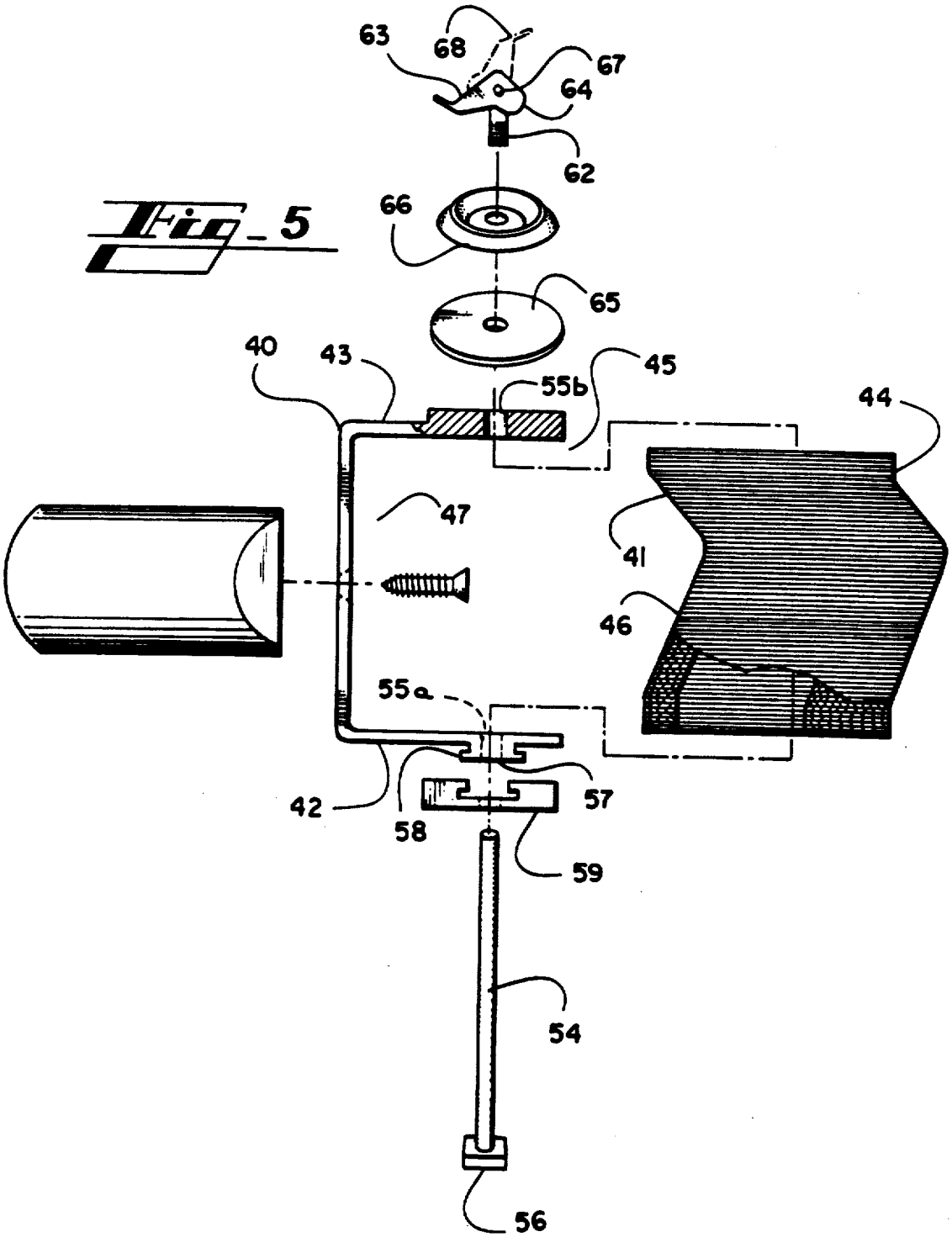
FIG. 5 is an exploded view of the contour sander shown in FIG. 1.

Each blade 41 has a pair of elongated holes 52 longitudinally aligned along the blade and elongated at a right angle to the longitudinal direction of the blade. A pair of bolts 54, one of which is shown in FIG. 5, extend through the corresponding holes 52 in the blades 41. These bolts 54 also extend through the aligned holes 55*a* and 55*b* in the sides 42 and 43 of the housing 40. Each bolt 54 has a square head 56 which fits within and engages mating countersunk holes 57 formed on the outside of the flanged rail 58 extending along the side 42 of the housing 40. The side molding 59 fits over the rail 58 by means of an internal slot mating with the flanged rail and pressure fitted onto the rail, such that the side molding covers the head 56 of each bolt 54 and retains those bolts in place. The side molding 59 presents a smooth, uninterrupted surface for sliding contact with the straight edge 16 of the tool guide, as explained below in greater detail.

The other end 62 of each bolt 54 extends through the hole 55*b* and threads into an insert pivotably attached within the lever 63. The lever 63 has a cam radius 64 confronting the side 43 of the housing 40. Washers 65 and 66 are mounted on each bolt 54 between the housing side 43 and the cam radius 64 of the lever 63. The geometry of the cam radius 64, relative to the axis 67 about which the lever 63 pivots, engages the washer 65 which is made of a compressible material and exerts axial force on the bolt 54 when the cam lever is pivoted to the position shown in phantom at 68 in FIG. 5. This axial force in turn tends to urge the housing sides 42 and 43 toward each other, thereby pressing together those sides to squeeze the individual blades 41 mounted within the housing.

Figure 6:
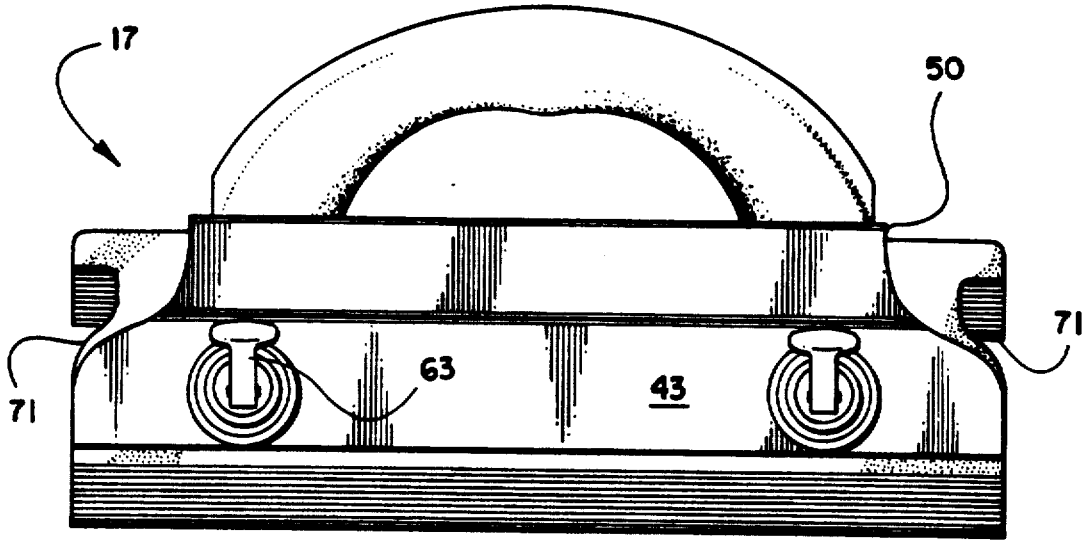
FIG. 6 is a front elevation view of the contour sander shown in FIG. 1.
Figure 7:
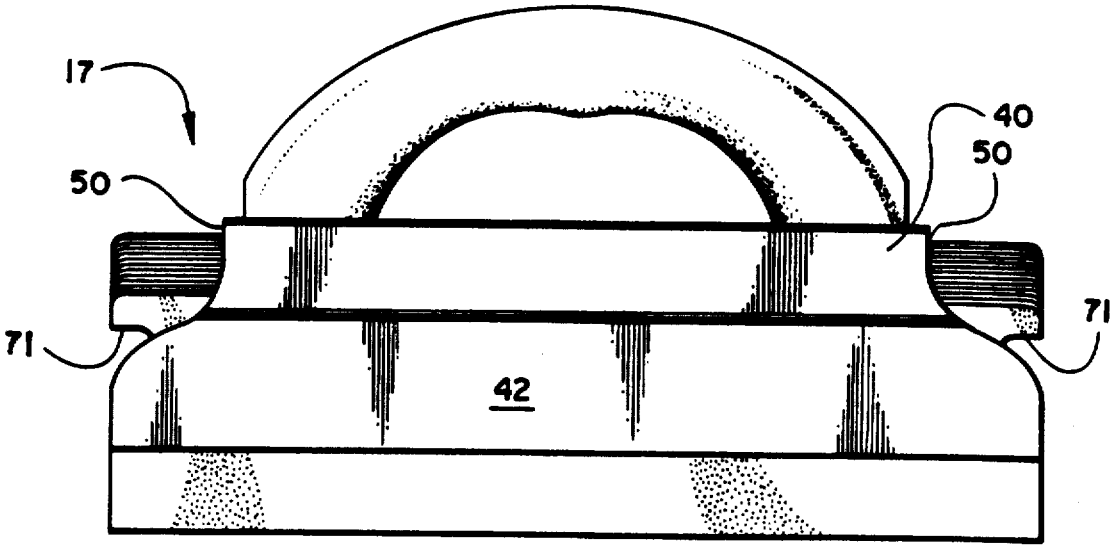
FIG. 7 is a rear elevation view of the contour sander shown in FIG. 1.

Turning again to FIG. 9, it is seen that the ends 51 of each blade 41 are notched out at 71, immediately below the upper edge 46 of the blade. These notches 71 correspond in location to the cut-away ends 50 of the housing 40, as best seen in FIGS. 6 and 7, and form finger grips for each blade permitting easy manual access of the notched blade ends by a user of the contour sander. The blades 41 also may have one or more holes 53, shown between the elongated holes 52 in the disclosed embodiment, to increase the structural strength of the blades and to reduce the weight of the contour sander 17.

Considering the operation of the described embodiments, it is assumed that an auto body panel 18 or the like has a longitudinally-extending region of contour 74 undergoing repair. This contour typically will have been built up by the application of body putty (not shown) to cover minor imperfections in the repaired panel. The contour region 74 now must be sanded to match the nominal contour of the undamaged body panel for that region. To accomplish this result, the levers 63 of the contour sander 17 are placed in the released position shown in solid line on FIG. 5. This release allows the sides 42 and 43 of the housing 40 to assume their normal position wherein the blades 41 within the housing are free of compression by the housing sides. The contour sander 17 next is held against an undamaged portion of the contour 74, so that the lower edges 44 of the blades 41 are substantially parallel with the longitudinal extent of the contour. The goal at this time is that each blade 41 is extended outwardly until its lower edge contacts a confronting longitudinal extent of the contour 74. The finger grips provided by the notches 71 at the ends 51 of each blade 41 enable the operator to lift up or press down individual blades either to insure full contact of each blade with the underlying contour 74, or in some cases either to retract that blade from the contour surface or to move the lower edge 44 of a particular blade downwardly below the nominal surface contour achieved by the entire group of blades. The index marks on the scale 48 help the operator select the appropriate blade for this purpose. Moving an individual blade upwardly so that its lower edge 44 is withdrawn from the contour may be desirable where the width of the contour 74 is somewhat less than the corresponding width of all blades 41 within a particular contour sander. Lowering one or more individual blades 41 below the nominal surface of the contour is desirable where necessary to duplicate or reproduce a given contour that possesses more definition than the relatively gentle contour 74 shown in FIG. 1. Whatever the need, the individual notches 71 provided on each blade 41, combined with the cutaway regions 50 on the housing 40 of the contour sander, permit the operator to readily grasp and manipulate each individual blade with one hand, while holding the contour sander 17 against the contour with the other hand, until the lower edges 44 of the blades are adjusted to provide the desired match of the surface contour.

Figure 10:
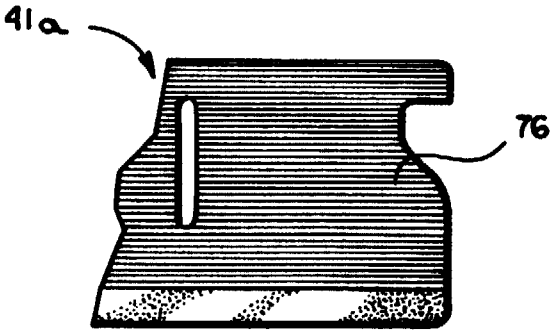
FIG. 10 is a fragmentary view of a contour sander blade according to an alternative embodiment.

With the desired positions of the individual blades 41 thus set, the levers 63 now are manipulated to clamp together the blades and maintain that desired contour. This takes place either by rotating the levers 63 around the axis of the bolt 54, thereby drawing the threaded insert within the lever inwardly relative to the bolt head 56 and thus squeezing together the sides 42 and 43 of the housing 40. Alternatively, each lever 63 can be moved to the position 68 shown in FIG. 5, which moves the cam-locking surfaces 64 to squeeze together the sides 42 and 43. In either case, the sides 42 and 43 firmly squeeze together the blades 41 so that those blades in effect become a unitary mass which fixes the contour represented by the individual lower edges 44 of the blades. To assist in so engaging the individual blades to each other, each side surface 75 of the blades may optionally have a surface which presents a good frictional grip upon the confronting side surface of the neighboring blade when the blades are locked within the housing 40. For example, providing blades with a relatively fine textured finish will assist in interlocking the blades, particularly where the blades are made of a resilient or elastomeric material such as rubber or the like. Alternatively, FIG. 10 shows an alternative embodiment of blade 41*a* wherein the sides contain a large number of relatively minute longitudinal grooves or striations 76. These striations on each adjacent blade engage one another when the blades are clamped together, providing a positive locking effect. If striated blades are employed, the number of such striations per unit height of the blade must be great enough so as not to unduly interfere with the vertical adjustment of each blade relative to its neighbor.

Figure 8:
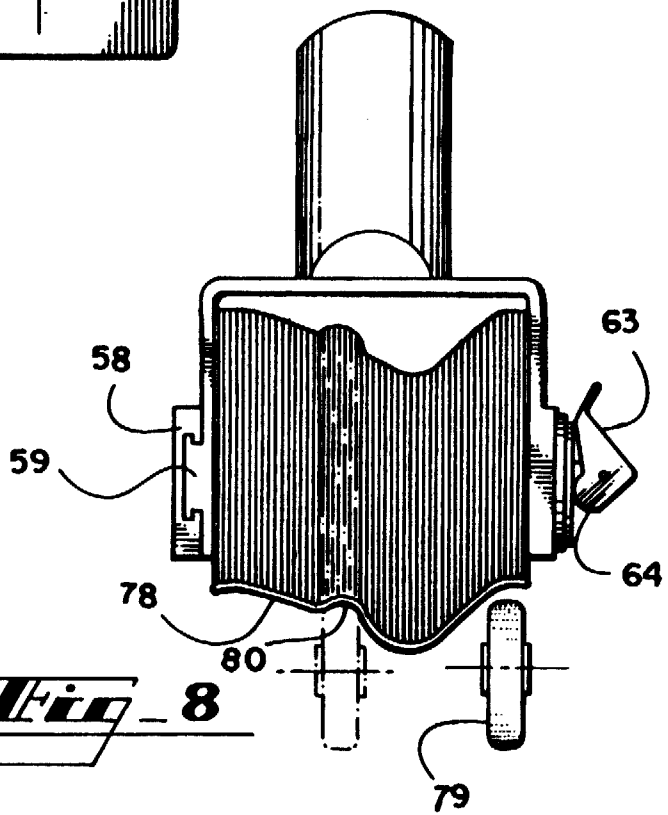
FIG. 8 is an end elevation view of the contour sander in FIG. 1, showing the individual blades adjusted to fit a particular contour and further showing a roller used to conform sandpaper to the contour.

Once the blades 41 of the contour sander 17 are set to the desired contour, a sheet of abrasive or polishing cloth such as sandpaper 78, FIG. 8, is affixed to the contour represented by the lower edges 44 of the blades. The sandpaper 78 is adhered to the edges of the blades by adhesive or the like, as is known in the art. Where the blades 44 have been set to represent a relatively sharp or distinct contour as shown in FIG. 8, it may be desirable to use a small roller 79 pressed against the sandpaper 78 to firmly urge the sandpaper fully against and into the valleys 80 created by the relatively sharp contours which the present contour sander is capable of producing. The roller 79 may conveniently be mounted on an axle at one end of a handle (not shown) which enables an operator to traverse the sandpaper 78 as necessary to conform the sandpaper with the blade contour.

With the contour sander 17 now prepared, the operator next places the tool guide 15 on the panel 18 so that the straight edge 16 of the tool guide is laterally offset a short distance from the contour 74 to be sanded. The knobs 34 are loose at this time, and the straight edge 16 should approximately parallel the longitudinal axis of the contour 74 at this time. With the tool guide 15 thus positioned, the operator next presses downwardly on the knobs 34 of the several suction cups 19 mounted on the tool guide, thereby adhering the suction cups to the panel 18. With the suction cups 18 thus adhered to the surface of the panel 18, the body 15 now is adjusted to place the straight edge 16 for exact parallelism with the contour 74. The slotted openings 31 in the tongues 20, through which the suction cup studs 33 pass, allow the body 15 an extent of lateral movement for this purpose. The tongues 20 also allow locating the tool guide 15 relatively close to obstructions like mirrors or protruding door handles, so long as the suction cups 19 do not interfere with those obstructions. Once the straight edge 16 is properly aligned, each knob 34 then is tightened until the outer portions 30 of the tongues 20 are securely engaged on the suction cups. The suction cups and the bumper strip 25 maintain the tool guide 15 out of contact with the surface of the panel 18, preventing marring or otherwise damaging of that surface.

As each knob 34 is tightened on the stud 33, the acutely-angled outer portion 34 of each tongue 20 causes the suction cups to skew away from the remainder of the tool guide 15, as best shown in FIG. 2A. This skewed angularity of each suction cup in turn applies to each tongue 20 a bending force causing the tongues to function as cantilevers which urge the tool guide body 15 downwardly into firm contact with the panel 18. This downward force tends to flatten the bumper strip 25 as illustrated in FIG. 2A, but the bumper strip continues to prevent the straight edge 16 or any other metal portion of the tool guide from contacting the panel 18. If the bumper strip 25 will be pressed against semisoft body putty in a particular application, it may be advantageous to provide a removable plastic shroud which covers and protects the bumper strip. The tool guide 15 thus is attached to the panel 18, ready to function as a guide for back-and-forth operation of the contour sander 17.

The contour sander 17 now is grasped by its handle 22 and held with the side molding 59 engaging the rounded straight edge 16 of the tool guide. The contour sander next is pressed against the surface of the panel 18, placing the sandpaper 78 in contact with the contour 74 on the panel. With the side molding 59 remaining in contact with the straight edge 16 of the tool guide, the contour sander 17 now is moved back and forth along the contour 74, as necessary to achieve the desired surface finish of that contour. The straight edge 16 remains firmly affixed to the panel at this time, providing a positive guide enabling the operator to move the contour sander back and forth without worrying about maintaining the proper lateral position of the sander so long as the side molding 59 remains in contact with the straight edge 16. Because the straight edge 16 typically is made of a metal such as aluminum or steel, the side molding 59 preferably is of a material having a relatively low coefficient of friction against such metals. The overall design of the present sander allows a relatively compact tool having a low center of gravity, reducing both operator fatigue and the need to manually hold the sander to prevent tippage while moving the sander back and forth along a straight edge.

Once the contour 74 is sanded to satisfaction, the tool guide 15 is released from the panel 18 simply by loosening the knobs 34 until the outer portions 30 of the tongues 20 again become loose on the suction cups as illustrated in FIG. 2. The suction cups 19 then are removed from the panel 18, freeing the tool guide 15 for relocation on the panel 18 or for use elsewhere.

Two or more tool guides 15 can be temporarily interconnected if necessary to provide an interrupted straight edge 16 longer than an individual tool guide. This is illustrated in FIGS. 3 and 4, where a second tool guide fragmentarily shown at 84 is attached in abutting end-to-end relation with the tool guide 14 by means of the attachment connector 85. This connector includes a pair of holes 86 which mate with the holes 87 formed at each end of the longitudinal body 15 of each tool guide. The clamp 85, as best seen in FIG. 4, includes a back portion 94 formed with a downturned end portion **94*a* extending forwardly in spaced-apart relation somewhat in the shape of a lazy-J to define a slot 88 which hooks around the aligned opposite sides 21 of the interconnected tool guides. The forward end 89 of the clamp 85 includes an edge 90 extending downwardly to confront the flat surface of the tool guide body 15. The main body 91 of the clamp, extending backwardly from the forward end 89 to a point in front of the holes 86 extending through the tool guide, is raised upwardly as at 92 so as to be spaced apart from the surface of the body 15. Each bolt 93 extends through an aligned hole 86 in the connector 85 and hole 87 in the bodies 15 and engages the nut 95 on the underside of the tool guide body 15. Each nut 95 contacts the downturned end 94*a* to hold the nut in place while tightening or loosening the bolt. Tightening those bolts forces the inwardly-facing surface 90 of the forward end 89 downwardly against the top of the bar and firmly interconnects the bodies 15** of the two tool guides. The interconnected tool guides then are attached to a work surface in the manner previously described.

Figure 11:
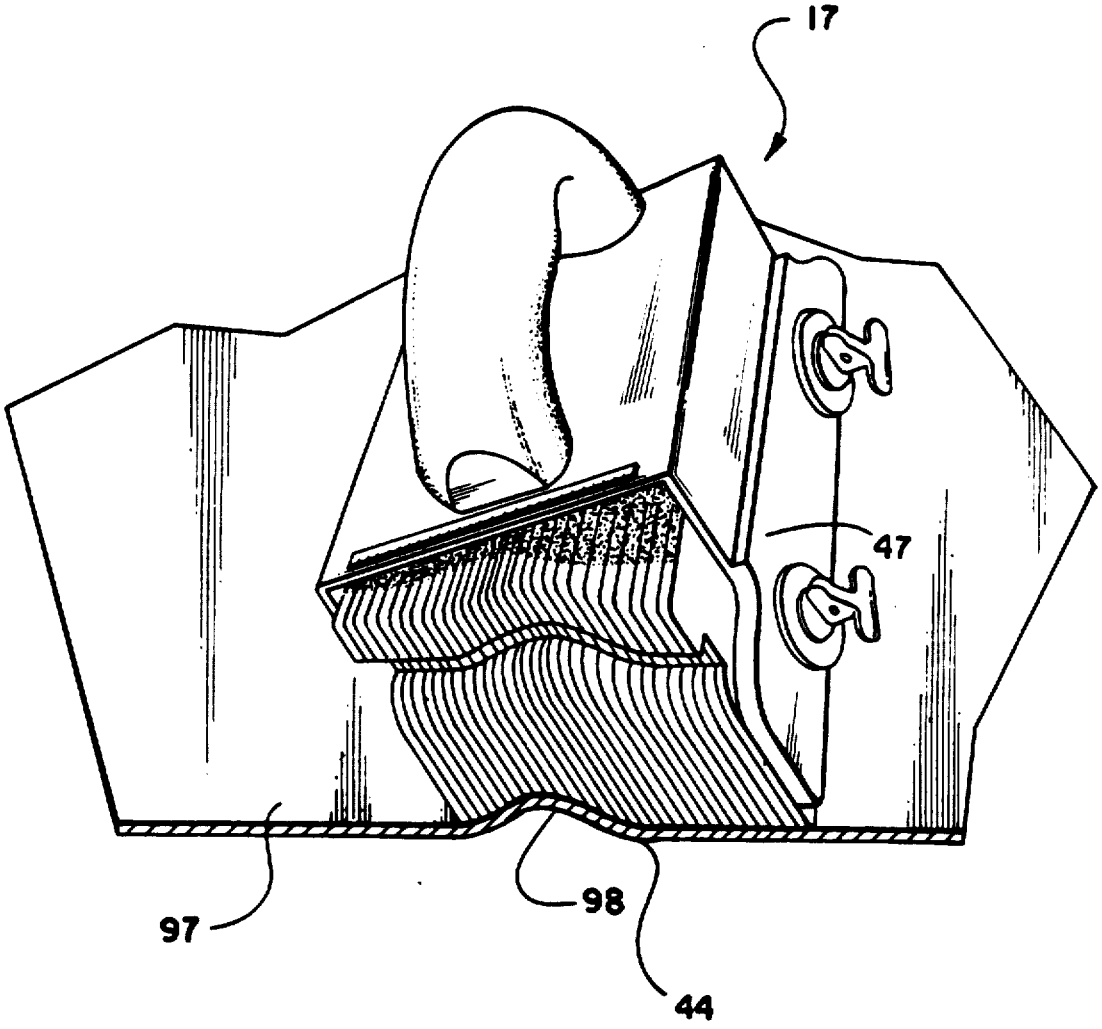
FIG. 11 is a pictorial view showing the contour sander of FIG. 1 at an oblique angle to a work piece.

Although FIG. 1 shows a typical use of the contour sander 17 positioned with the several blades 41 substantially perpendicular to the panel 18, FIG. 11 shows an alternative technique for using the contour sander. In FIG. 11, the sander 17 is at an acute angle to the nominal plane of the surface 97 being sanded. Although the blades in the contour sander are adjusted so that the lower edges 44 meet the particular contour 98 of the surface 97, the planes of those blades likewise describe an acute angle with the surface. This disposition of the sander 17 and the blades 41 within that sander is made possible by the substantial head room in the upper region 47 of the sander housing 40, above the upper edges 46 (FIG. 5) of the individual blades. The existence of this head room in the upper region 47 permits disposing the housing 40 at an acute angle to the contour 98 when the levers 63 of the sander are loosened to permit adjusting the blades 41 to the contour. Once the blades are adjusted with the sander housing 40 in the desired acutely-angled position, the levers 63 are tightened and the blades are squeezed together so as to maintain the contour in the manner described above.

This angled position of the sander as shown in FIG. 11 is useful, for example, to sand regions adjacent protruding body parts such as door handles or external mirrors, which otherwise interfere with the worker's hands or with part of the contour sander itself. Moreover, by positioning the contour sander 17 as shown in FIG. 11 with the side 42 of the housing 40 closer to the surface 97 than the side 43, the side molding 59 (not shown in FIG. 11) is moved closer to the surface. This ability to adjust the elevation of the side molding 59 relative to the work surface is useful where contour of the work surface places the straight edge 16 of the tool guide 14 relatively close to the work surface.

Although the tool guide 14 is described above for use as a straightedge in connection with the contour sander, the tool guide has alternative uses. For example, the tool guide 14 may be temporarily attached to a replacement windshield, allowing a single tool guide to fit along substantially the width of the windshield with the tool guide flexing to the contour of the windshield and thereby providing a single gripping tool allowing the installers to position the replacement windshield within the existing frame. The tongues 20 are spaced outwardly from the workpiece surface, as seen in FIG. 2A, far enough to grasp the tongue and lift the tool guide to position the windshield. As was the case with body panels, the bumper strip 25 and the suction cups 19 maintain the body 15 isolated from the glass, thereby avoiding scratching or other damage to the glass.

Still other alternative uses of the tool guide 14 are as a grip-down holder to temporarily secure replacement side moldings onto a body panel, and to hold fireproof blankets in place onto a vehicle body during welding. Magnets presently are used to hold such blankets in place, but the magnets invariably attract iron filings which can cause significant damage to a finshed surface if the magnet inadvertently contacts that surface. Of course, it should be obvious to one of ordinary skill in the art that the tool guide 14 can also function as a utility straight edge on any smooth, nonporous surface to which suction cups can adhere. Further yet, a utility holding tool can be provided by using a single suction cup 19 combined with a tongue 20 having a bumper 28 at the outer end of the tongue, substantially as shown in FIG. 2. An article is placed on a suitable surface beneath the bumper 28, and the suction cup 19 is clamped to the surface to support the article in place on the surface.

It should be apparent that the foregoing relates only to a preferred embodiment of the present invention, and that numerous changes and modifications therein may be made without departing from the spirit and scope of the following claims.

I claim:

1. Apparatus for shaping the contour of a work surface, comprising:

a plurality of flat blades each having a proximal longitudinal edge for contacting the work surface and a distal edge remotely located from the proximal edge;

clamp means enclosing a part of each distal edge and loosely holding the blades in a parallel contiguous array with the proximal edges exposed in side-by-side juxtaposition for contact with the work surface so that the proximal edges collectively conform to the contour of the work surface, the clamp means being selectively operative to tightly clamp together the blades so as to maintain the relative position of the blades in the collective contour; and handle means on another part of each blade not enclosed by the clamp means and, so that the position of each individual blade can be adjusted relative to the other blades by manually manipulating the handle means and moving the individual blade.

2. Apparatus as in claim 1, wherein:

each blade has first and second ends located outside the part enclosed by the clamp means and the handle means comprises a separate finger grip formed on each end of the blades in position for manually grasping the blade outside the part enclosed by the clamp means.

3. Apparatus as in claim 2, wherein:

each end of the blades includes a region located between the proximal and distal edges and recessed longitudinally inwardly, thereby defining the finger grip at the end of the blade.

4. Apparatus as in claim 2, wherein:

the clamp means includes a housing having sides mutually spaced apart to receive the blades therebetween; and the sides have ends with portions thereof cut away to expose the finger grips on the blades.

5. Apparatus as in claim 3, wherein:

each blade has side surfaces which present a relatively high frictional engagement with the side confronting surfaces of the proximal blades when clamped together by the clamp means, thereby preventing slippage of the blades and assisting in maintaining the collective contour.

6. A contour sander for shaping the contour of a work surface, comprising:

a generally U-shaped housing having a top and a pair of sides extending outwardly from the top, the sides being mutually parallel and spaced apart from each other;

a plurality of flat blades retained between the sides of the housing, each blade having a proximal edge for contacting the work surface and a distal edge remote from the proximal edge, and the proximal edges being aligned in side-by-side juxtaposition for contact with the work surface so that the proximal edges can collectively conform to the contour of the work surface;

means associated with the housing to selectively urge the sides toward each other, thereby tightly clamping the blades together between the sides and maintaining the relative position of the blades in the contour of the work surface;

the blades having ends extending beyond the housing; and each such end having a finger grip member for manually extending or retracting each individual blade relative to other blades, so as to move the proximal edge of that blade outwardly or inwardly with respect to the proximal edges of the other blades as required to shape the contour of the work surface.

7. The contour sander as in claim 6, further comprising:

a scale disposed on the housing and containing visible index marks in juxtaposition with the blades, so as to assist in selecting the appropriate blade or blades for said manual extension or retraction relative to other blades.

8. The contour sander as in claim 6, further comprising:

a molding member on one side of the housing, the molding having a relatively smooth uninterrupted surface for sliding contact with a straight edge held in fixed relation to the work surface so that a person can move the contour sander on a predetermined path substantially parallel to the contour of the workpiece by moving the contour sander back and forth along the straight edge.

* * * * *